United States Patent [19]

Hill

[11] 4,076,005

[45] Feb. 28, 1978

[54] ARCHERY BOW

[76] Inventor: James H. Hill, 995 W. 100 South, Provo, Utah 84601

[21] Appl. No.: 710,432

[22] Filed: Aug. 2, 1976

[51] Int. Cl.[2] ..... F41B 5/00

[52] U.S. Cl. ..... 124/24 R; 124/90

[58] Field of Search ..... 124/24 R, 23 R, 80, 124/86, 88, 90, 41 A, 41 R, 22

[56] References Cited

U.S. PATENT DOCUMENTS

| | | | |
|---|---|---|---|
| 2,001,470 | 5/1935 | Nyvall | 124/24 R |
| 2,426,283 | 8/1947 | Pearson | 124/23 R |
| 2,457,793 | 12/1948 | Bear | 124/23 R |
| 2,514,638 | 7/1950 | Grenier | 124/23 R |
| 3,527,196 | 9/1970 | Karbo | 124/24 R |
| 3,612,028 | 10/1971 | Karbo | 124/24 R |
| 3,957,027 | 5/1976 | Drake | 124/23 R |

*Primary Examiner*—Harland S. Skogquist
*Assistant Examiner*—William R. Browne
*Attorney, Agent, or Firm*—Mallinckrodt & Mallinckrodt

[57] ABSTRACT

An archery bow having a pair of bow limbs pivotally connected together in end-to-end relationship, whereby the bow limbs can be folded so that the backs of the respective bow limbs face each other. The interconnected end portions of the bow limbs are preferrably enlarged with respect to the remainder thereof forming a handle portion of the bow. The handle end portions are provided with passageways therethrough extending from the bellyside to the backside thereof. An endless bowstring extends from the backside of the bow through the passageways in the handle end portion of the bow and around the ends of the respective bow limbs. The bow limbs can also comprise a pair of flexible, elongate members attached, respectively, to the backsides of the limb members to extend inwardly from the tip ends thereof, with their inwardly extending ends being firmly secured to the respective limb members. Elongate members are pivotally attached to the tip ends of the respective limb members, with corresponding ends thereof positioned between the limb members and the flexible members of the respective bow limbs, and with the other ends thereof extending outwardly from the tips of the limb members. The bowstring is strung between the outwardly extending ends of the pivot members. When the bowstring is drawn, the pivot members rotate so that the ends thereof between the limb members and the flexible members deflect the flexible members, thereby developing tension in the bowstring.

15 Claims, 12 Drawing Figures

ARCHERY BOW

BACKGROUND OF THE INVENTION

1. Field

The invention pertains to archery bows and, in particular, to bows which can be folded and to compound bows.

2. State of the Art

Archery bows are relatively awkward and cumbersome to carry and transport because of their elongate nature. Demountable archery bows, constructed of two or more pieces which can be assembled and disassembled, are somewhat less cumbersome to carry than a conventional bow because of the relatively shorter dimensions of the separate disassembled pieces; however, the separate pieces and the loose bow string are still awkward to handle. In addition, the assembly of such bows is relatively time consuming, making them unsuitable where the bow must be quickly and quietly assembled upon sighting of the target, such as in hunting.

Attempts have been made to overcome the shortcomings of the demountable bows by providing a two-piece bow in which the pieces are connected together by hinge means and can be folded together as an integral unit. To maintain strength and rigidity in the handle portion of the bow, it was taught (in U.S. Pat. Nos. 3,527,196 and 3,612,028) that the hinge axis should be in the same direction as the draw of the bow. Accordingly when the bow is folded, the limbs are rotated into side-by-side relationship. Although the bow limbs remain in essentially one piece when folded, the bowstring falls loose and must be taken care of separately. In addition, when the bow is realigned to its operable position, the bowstring must be manually restrung on the bow.

SUMMARY OF THE INVENTION

In accordance with the present invention, a foldable archery bow is provided comprising a pair of bow limbs and hinge means connecting the bow limbs together in end-to-end relationship for pivotal movement about an axis adjacent the back of the bow and transverse to the draw of the bow. The bow is thus characterized in that the bow limbs can be folded upon themselves with the back of the limbs facing each other, and when in their operable positions, the limb members are held firmly in end-to-end relationship by the tension in the bowstring.

In a preferred embodiment, the corresponding, interconnected end portions of the bow limbs are enlarged with respect to the remainder of the limbs so as to form a handle portion of the bow. Each of the enlarged ends has a passageway therethrough extending from the bellyside to the backside of the bow. The outer ends of the bow limbs are provided with pulleys whose axes are transverse to the plane of the bow. An endless bowstring extends from the backside of the bow through the passageway in the handle end portion of one of the limbs, around the pulley of that limb, to and around the pulley at the end of the other limb, and through the passageway in the handle end portion of the other limb to its origin at the back side of the bow. This embodiment is of particular advantage in that the limbs of the bow can be folded to their back-to-back position without removing the bowstring or without the bowstring becoming loose, i.e. the bowstring is self-storing. When the bow limbs are again rotated to their end-to-end, operable position, the bowstring automatically assumes its proper position strung between the ends of the bow.

In another advantageous embodiment, the bow limbs comprise elongate limb members having flexible, elongate members attached to the backsides thereof, respectively. The flexible, elongate members are positioned so as to extend inwardly from the tips of the respective limb members along at least a portion of the backsides of the limb members. A pair of elongate pivot members are pivotally attached at a point intermediate their ends to the tip ends of the limb members, respectively, with corresponding ends of the respective pivot members being positioned between the limb members and the flexible member of the respective bow limbs. The opposite ends of the pivot members extend outwardly from the tip ends of the limb members of the respective bow limbs. The outwardly extending ends of the pivot members are adapted to have a bowstring strung therebetween. As the bowstring is drawn, the pivot members rotate about their pivot connection to the limb members, and the ends of the pivot members located between the limb members and the flexible members deflect the flexible members. The force required in drawing the bowstring gradually decreases as the bowstring approaches the fully drawn position, and the archer can achieve better aim due to the reduced tension in his arm when the bowstring is fully drawn. In addition, when the archer releases the drawn bowstring and arrow, energy stored in the stressed flexible members is progressively released to the bowstring and arrow. In conventional bows, the maximum force exerted by the archer is at full draw of the bowstring, and the correct aiming is difficult because of the tension which has to be maintained in the archer's arms as he aims. Further, the energy stored in the limbs of the bow is instantaneously released at the instant the drawn bowstring is released.

THE DRAWINGS

Embodiments representing the best mode presently contemplated of carrying out the invention are illustrated in the accompanying drawings, in which:

FIG. 1 is a side elevational view of a foldable bow of the present invention shown in its extended, operable position;

FIG. 2, a front elevational view of the bow shown in FIG. 1;

FIG. 3, a side elevational view of the bow of FIG. 1 shown in its folded position with the backs of the bow limbs facing each other;

FIG. 4, a cross-sectional view through the handle portion of the bow taken along line 4—4 of FIG. 2;

FIG. 5, a cross-sectional view taken along line 5—5 of FIGS. 1 and 4;

FIG. 6, a cross-sectional view taken along line 6—6 of FIGS. 1 and 4;

FIG. 7, a cross-sectional view taken along line 7—7 of FIGS. 2 and 4;

FIG. 8, a side elevational view of an alternative embodiment of a foldable bow of the present invention;

FIG. 9, a side elevational view of the bow of FIG. 8 shown with the bowstring in the fully drawn position;

FIG. 10, a plan view of the double pulley system;

FIG. 11, a cross-sectional view taken along line 11 of FIG. 10; and

FIG. 12, a side elevational view of yet another embodiment of a bow of the present invention.

DETAILED DESCRIPTION OF THE PREFERRED EMBODIMENTS

Figure 1:
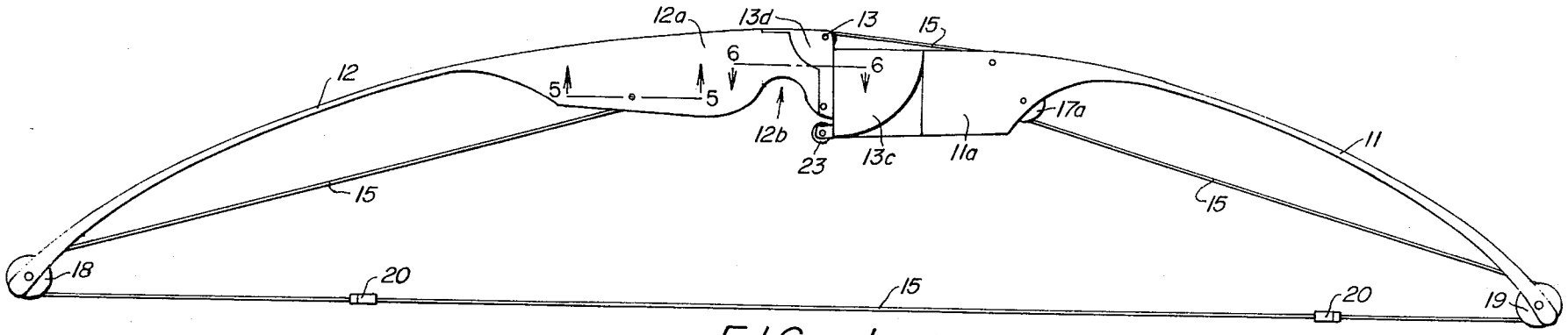

Preferred features of one embodiment of a bow in accordance with the present invention are shown in FIGS. 1–7. The bow comprises a pair of bow limbs 11 and 12 which are connected together in end-to-end relationship by hinge means 13. The respective ends of the bow limbs 11 and 12 which are connected together are enlarged to form handle portions 11*a* and 12*a* of the bow. A pistol grip 12*b* is formed in the handle portion. As in conventional bow terminology, bow limb 11 is called the upper limb, and bow limb 12 is called the lower limb. Further, the side of the bow facing the archer during use of the bow is referred to as the belly of the bow, with the opposite side referred to as the back of the bow.

The upper and lower limbs 11 and 12 are interconnected by hinge means 13 for pivotal movement about an axis which is adjacent the back of the bow and transverse to the direction of the draw of the bow. That is, the bow limbs 11 and 12 are pivotally interconnected by the hinge means 13 so that the limbs 11 and 12 can be rotated from their aligned, operable position as shown in FIGS. 1 and 2, to a folded position as shown in FIG. 3, in which the limbs 11 and 12 are adjacent each other with their backs facing each other.

The hinge means 13 comprises hinge plates 13*a* and 13*b* (FIG. 2) which are pivotally connected to the hinge axis pin and securely attached to the respective bow limbs 11 and 12. The respective hinge plates 13*a* and 13*b* have flanges 13*c* and 13*d* extending perpendicularly therefrom and adjacent the respective lateral sides of the bow. These flanges form protective end caps for the ends of the handle portion of the respective bow limbs 11 and 12. A notch 14 (FIG. 2) is formed in the handle portion of the upper limb 11 as in conventional bows to provide an open sight of the target along the drawn arrow when the bow is being aimed. The notch 14 requires that the width of the hinge plate 13 associated with the upper limb 11 be no more than the width of the backside of the bow limb less the depth of the notch 14. The flange 13*c* on the notch side of bow limb 11 preferably covers a substantial portion of the face of the notch 14. As illustrated, the flange 13*c* is essentially a quadrant of a circle with the center of such circle being adjacent the hinge axis of hinge 13. The flange on the side opposite the notch 14 is of similar size and shape as flange 13*c*, and the opposed flanges not only form an end cap for bow limb 11, but provide strength to reinforce the notched section 14.

Figure 2:
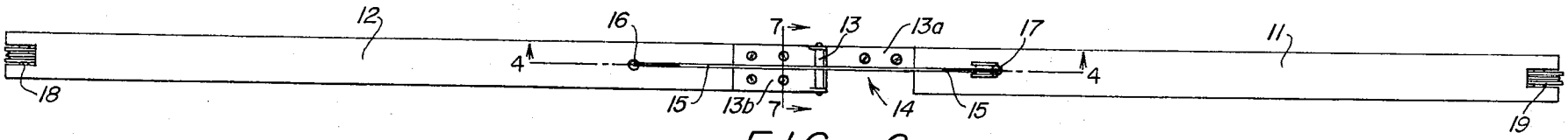
Figure 3:
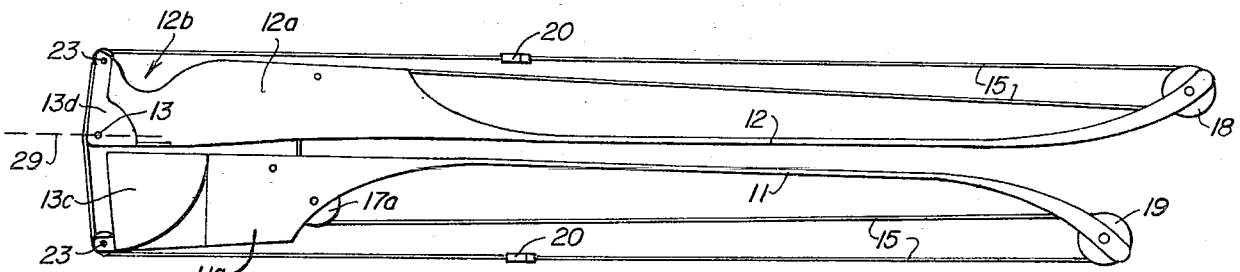

In the embodiment of the bow, as illustrated in FIGS. 1–7, passageways 16 and 17 extend through the respective handle end portions of bow limbs 11 and 12 from the bellyside to the backside thereof. An endless bowstring 15 extends from the backside of the bow through the passageway 16 in the lower limb 12 to the bellyside of the bow then around a pulley 18 at the free end of lower limb 12, to and around a pulley 19 at the free end of the upper limb 11, through the passageway 17 in the upper limb 11 to its origin at the backside of the bow. Preferably, the portion of the bowstring extending from the backside of the bow, to and around the pulleys 18 and 19, is constructed of a strong material such as flexible cord, rope, or metal cable, and is interconnected across the arc of the bow by a conventional bowstring material. As shown in FIGS. 1 and 3, the conventional portion of the bowstring is attached to the more rugged portion by connectors 20.

The bow illustrated in FIGS. 1–7 can be folded from the operable position, as shown in FIG. 1, to the folded position as shown in FIG. 3, without removing the bowstring 15. The bowstring 15 automatically assumes the position shown in FIG. 3 when the bow is folded. The bowstring remains taught in the folded position and actually helps retain the bow limbs 11 and 12 in their back-to-back relationship in the folded position. When the bow limbs 11 and 12 are again rotated to their operable position, the bowstring automatically assumes the position as shown in FIG. 1, and the bow is ready to be used without the necessity of restringing the bowstring.

Figure 4:
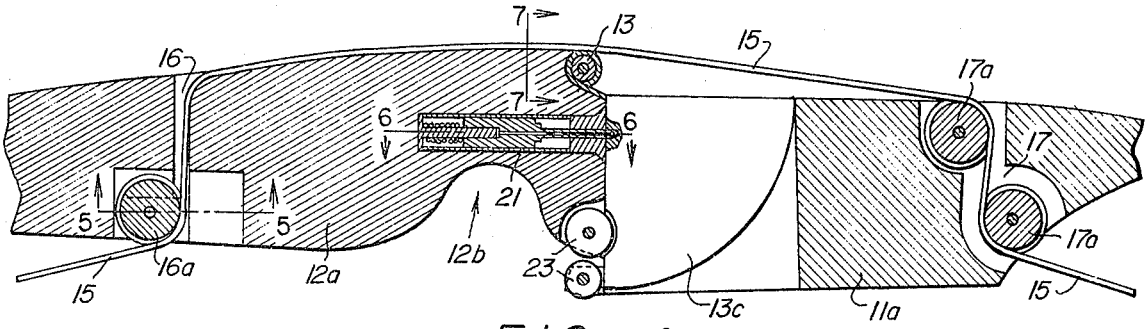
Figure 5:
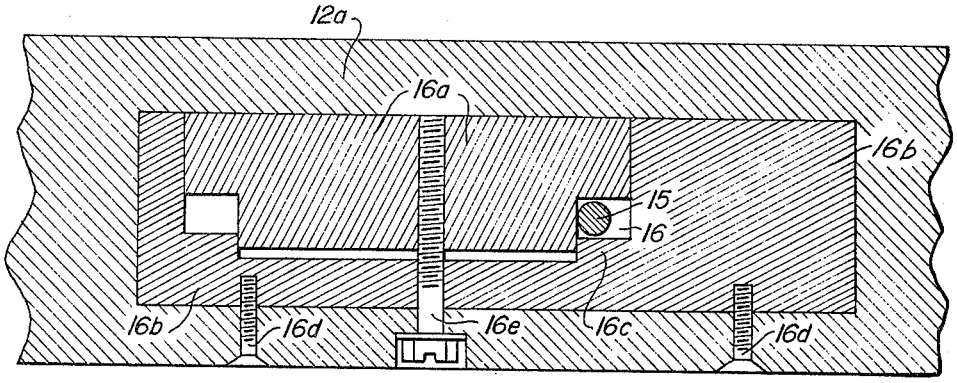

Preferred forms of the passageways 16 and 17 are shown in FIG. 4. A stationary guide wheel 16*a* is positioned adjacent the end of passageway 16 in the bow limb 12 on the bellyside of the bow. The bowstring 15 is guided around guide 16*a* and through the passageway 16. A pair of pulleys 17*a* are positioned at the respective ends of the passageway 17. The pulleys guide the bowstring through passageway 17 and allow the bowstring to move translationally through the passageway 17 with a minimum amount of friction, and without wearing the ends of the passageway 17 where the bowstring 15 passes thereabout in an arc. Relative movement of the bowstring 15 through passageway 17 occurs during normal shooting of the bow as well as when the bow is folded to or unfolded from its stowable position.

With relative movement of the bowstring being provided through passageway 17 in limb 11, there is no need to provide for such movement through the other passageway 16 in limb 12. In fact, it has been found preferable to constrain the bowstring 15 against translational movement through passageway 16, so that the bowstring 15 will return to the same relative position with the bow limbs after the bow has been used to shoot an arrow or has been folded to its inoperable position and then unfolded to be used again. In the embodiment shown in FIGS. 4 and 5, the constraint on bowstring 15 is provided by adapting at least one end of the passageway 16 to be adjustable in its size, so that the bowstring 15 can be gripped and held stationary with respect thereto. As illustrated, a rectangular indentation is formed inwardly into the handle portion 12*a* of the lower limb from the bellyside thereof. A stationary block 16*b* is fitted within the rectangular indentation and held securely by screws 16*d* extending into the block 16 from the handle portion 12*a*. The block 16*b* has a circular section cut out of it with a portion thereof opening outward from the bellyside of the handle portion 12*a*. The guide wheel 16*a* is adapted to be positioned within the circular cut out, with a section of the perimeter of the guide wheel 16*a* being exposed at the bellyside of the handle portion 12*a*. The circular cut out section has a raised flange 16*c* extending around its perimeter, and the guide wheel 16*a* has a corresponding notch cut therein. The flange 16*c* and notch form a circular opening around the guide wheel 16*a*, and the opening 16 through the remaining portion of the handle 12*a* is tangentially aligned with this circular opening, so that the bowstring 15 extends through opening 16, around the guide wheel 16*a*, and out from the exposed portion of the notch on guide wheel 16*a* at the bellyside of the handle portion 12*a* and engages the guide wheel 16*a*. When the tightening nut 16*e* is rotated clockwise, the guide wheel 16*a* is pulled towards the side of the handle portion 12*a*, to grip and hold the bowstring 15 between the notch on the guide wheel 16a and the flange 16c on the block 16b. The guide wheel 16a can be released by counterclockwise rotation of the tightening nut 16e.

Figure 7:
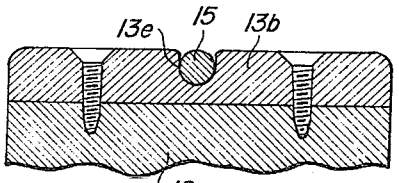

To streamline the backside of the bow, an indent is formed therealong between the passageways 16 and 17 to accommodate the portion of the bowstring 15 which passes therebetween. As shown in FIG. 7, the hinge plate 13b has an elongate indentation 13e in which the bowstring 15 lies. The portions of the backside of the bow, which are not covered with the hinge plates 13a and 13b and which are between the passageways 16 and 17, have an indentation formed therein similar to the indentation 13c shown in FIG. 7.

It has been found advantageous to have the butt ends of the handle portions 11a and 12a mate at an angle of slightly less than 90° with respect to the longitudinal axis of the bow. The longitudinal axis of the bow through the hinge 13 is shown by dotted line 29. As can be seen the butt ends of handle portions 11a and 12a of the bow form an angle of slightly less (i.e., up to about 15°) than a right angle. As the bow is folded to the position shown in FIG. 3, the angles of the butt ends produces an over-center type action which holds the bow limbs tightly together in back-to-back relationship. The bow limbs are shown tightly separated in FIG. 3 to clearly distinguish each bow limb. The force holding the limbs apart is not shown, and in the absence of such force, the limbs 11 and 12 would be held in back-to-back contact with each other. The bow limbs are, of course, urged towards each other in their folded position shown in FIG. 3 by the tension in the portion of the bowstring 15 extending between the passageway 16 and 17 in the handle portions of the bow. But, the over-center type action provided by the angled ends of the handle portions of the bow provide a convenient catch action which further holds the bow limbs together in back-to-back relationship.

The bow of the present invention can also be provided with a shock absorber means to prevent the handle portions from forcefully striking each other when the bow is rotated from the folded position to the operable position. Such a provision is especially advantageous if the bow is to be used for hunting. In such cases, the bow can be rotated to the operable position without making noise which might scare the intended prey.

Figure 6:
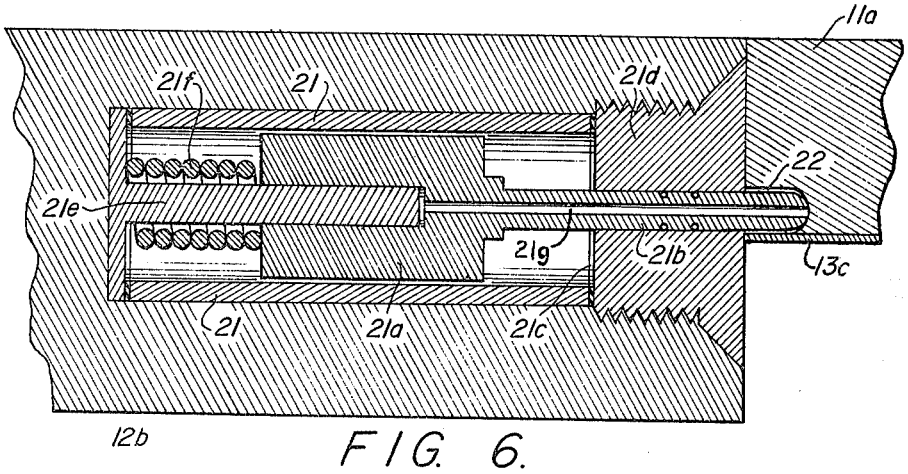
Figure 8:
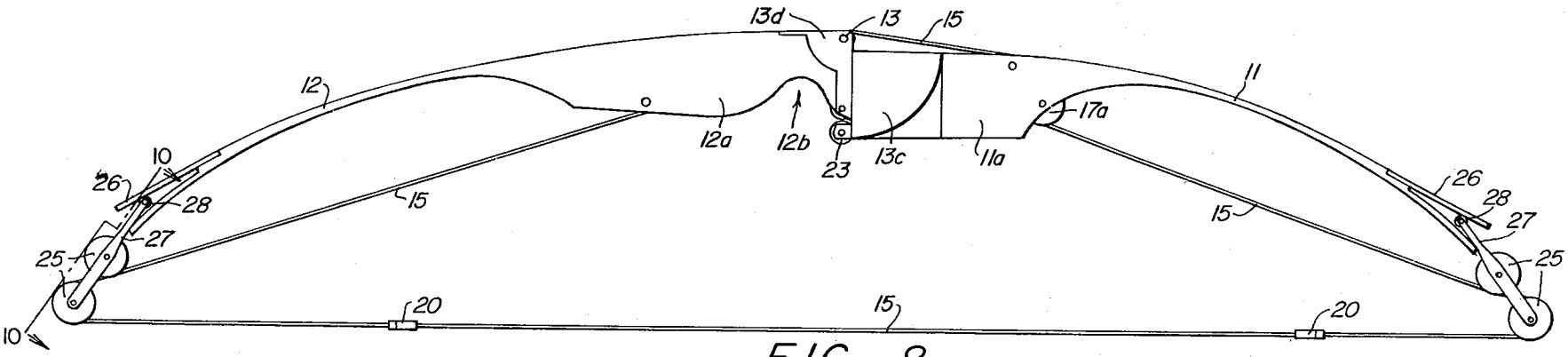

The shock absorber means, as shown in FIGS. 4 and 6 comprises a cylindrical unit 21 which is situated in a cavity extending longitudinally inward from the butt end of one of the handle portions of the bow. As shown, the cylindrical unit comprises a piston 21a which can move longitudinally within the unit. An elongate rod 21b extends from piston 21a through a seal ring 21c and an opening in a retainer screw 21d which hold the unit within the cavity of the handle portion 12a of the bow. The piston 21a is slightly smaller in diameter than the inside diameter of the housing of unit 21 so that oil can traverse from one side of the piston 21a to the other. A stud 21e extends axially upward from the inwardmost end of the unit 21. The piston 21a has a corresponding cylindrical bore therein so that it can slide longitudinally back-and-forth along stud 21e. A coil spring 21f is positioned around the stud 21e and urges the piston away from the innermost end of unit 21.

A slight recess 22 is provided in the butt end of the other handle portion 11a of the bow, so that when the bow is brought into operable position with the butts of the respective handle portions in face-to-face contact, the end of rod 22b of the shock absorber unit engages the recess 22 in the opposite handle portion.

When the bow is in its folded position, the spring 21f of the shock absorber unit 21 forces the piston 21a to its fully extended position. When the bow limbs are rotated to their operable position, the end of rod 21b engages the recess 22 before the butt ends of the respective handle portions comes into contact with each other. As the piston 21a is pushed inwardly into the unit 21, the oil passing from one side of the piston to the other creates a shock absorbing action which prevents the respective handle portions from making uncontrolled contact with each other. Instead, the butt faces of the handle portions are brought together in a smooth, relatively slow manner, rather than being snapped together.

An axial bore 21g can extend along rod 21b to the cylindrical recess in the piston 21a to allow passage of air to and from the cylindrical recess. The recess 22 can also be advantageously shaped so that it forms a frictional connection with the end of rod 21b. When such is the case, the shock absorber unit acts to dampen any tendency of the butt ends of the handle portion of the bow limbs to move relative to each other during the shooting of an arrow, and the bow becomes an essentially integral unit. The frictional engagement of the end rod 21b by the recess 22 can be overcome by a sustained force as is provided when the bow limbs are to be rotated to their folded position.

It has also been found advantageous to provide small pulleys 23 (FIGS. 1, 3, and 4) at the bellyside of the butt ends of the handle portions 11a and 12a, respectively. These pulleys form essentially frictionless guides for the bowstring to engage when the bow is rotated to its folded position.

Another embodiment of a bow in accordance with the present invention is shown in FIGS. 8–11. Parts of the bow which are the same for all practical purposes as corresponding parts of the bow shown in FIGS. 1–7 are identified by like reference numbers. In the embodiment shown in FIGS. 8–10, a double pulley system 25 is incorporated at the extreme ends of the bow limbs 11. A single pulley could be used, as is shown in the embodiment of FIGS. 1–7 and, alternatively, the double pulley system shown in FIGS. 8–11 could be used on the bow shown in FIGS. 1–7.

The major distinction in the bow shown in FIGS. 8–11 is in the tip ends of the bow limbs, by which the bow can be made to almost truly compound in its action, i.e., almost no force being needed to hold the bowstring in its fully drawn position. As illustrated, the bow limbs comprise elongate limb members 11 and 12 which are connected together in end-to-end relationship. A pair of flexible, elongate members 26 are attached, respectively, to the backsides of the limb members so as to extend inwardly from the tip ends of the limb members along at least a portion of the backsides of the limb members, with the inwardly extending ends of the flexible members 26 being firmly secured to the respective limb members.

Figure 9:
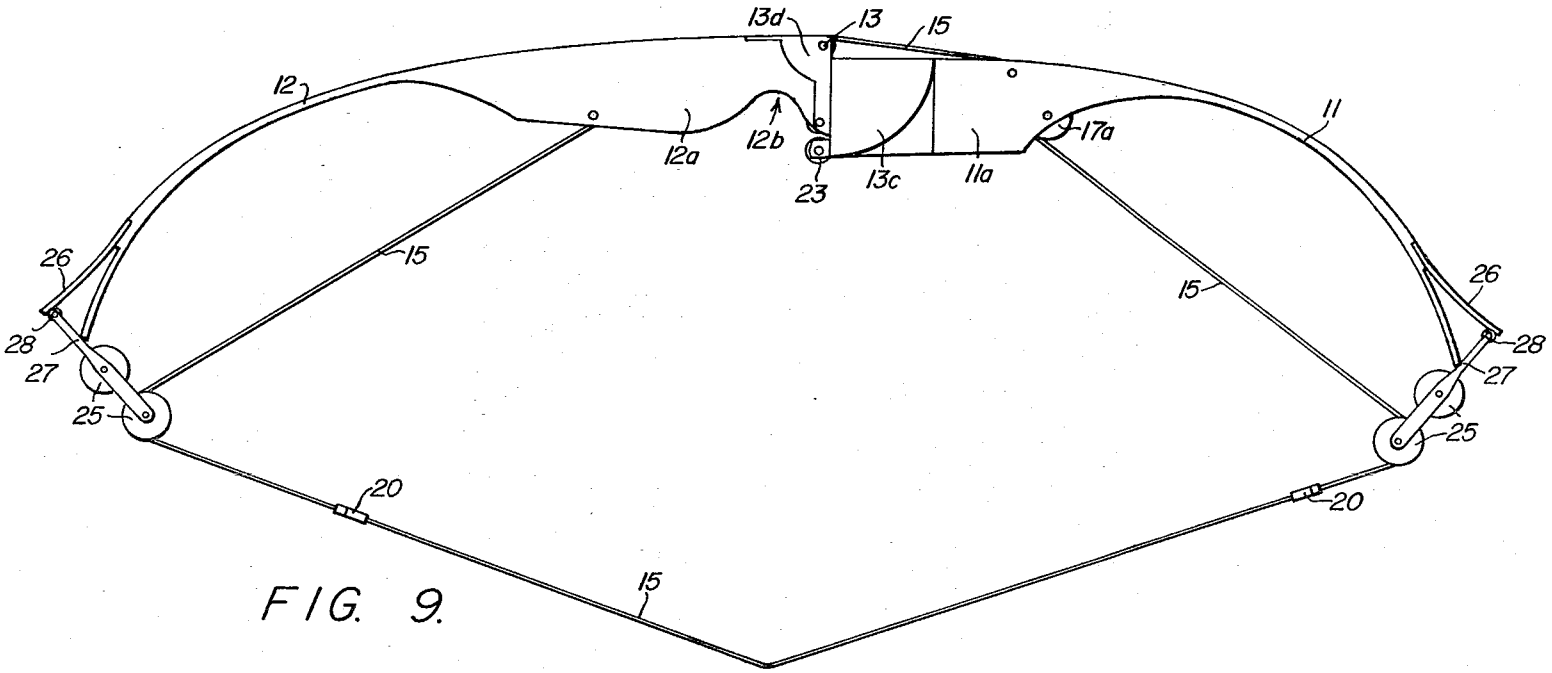
Figure 11:
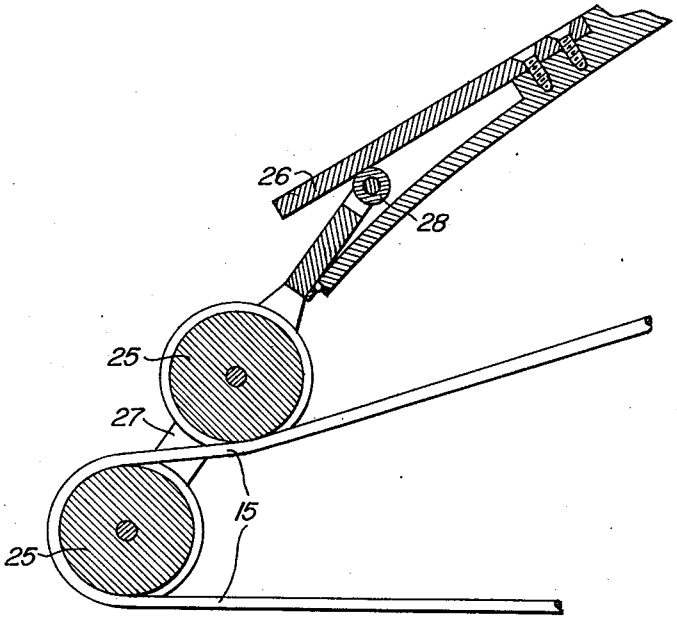
Figure 10:
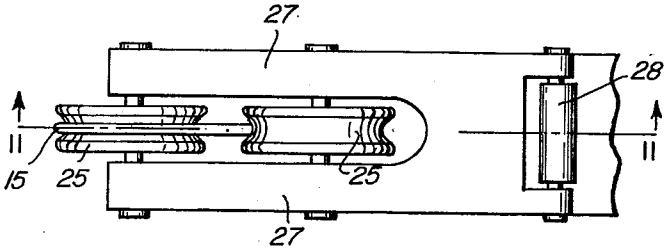

A pair of rigid, elongate pivot members 27 are pivotally attached to the tip ends of the limb members, respectively. Each pivot member 26 is attached to the tip end of a corresponding limb member at a point intermediate the ends of the pivot member. Corresponding ends 27a of the respective pivot members 27 are positioned between the tip ends of the respective limb members and the corresponding flexible members 26, with the opposite ends of the respective pivot members 27 extending outwardly from the tip ends of the corresponding limb members. The double pulleys 25 are positioned in line along the extending end portion of each of the pivot members. The bowstring 15 extends around each of the outside pulleys of each of the sets of double pulleys 25 so that when the bowstring is drawn, as shown in FIG. 9, the pivot members are rotated, and the ends thereof located between the limb members and the flexible members deflect the flexible members away from the limb members. The bending moment in the flexible members produces a force on the ends of the pivot members. As the bowstring is drawn to its fully drawn position, as shown in FIG. 9, there is a maximum bending moment produced in the flexible members; however, the torque produced in the pivot members is minimal because the force being exerted on the ends of the pivot members by the flexible members acts in a direction almost in line with the pivot point of the pivot members. Thus, when the bowstring is fully drawn, the force to be applied by the archer to maintain the drawstring in that position is very small in comparison to the pull required to initiate the draw of the bowstring. Accordingly, the archer can take careful aim without being hampered by having to exert full strength in holding the bowstring in its drawn position.

Moreover, the energy stored in the stressed flexible members is progressively released to the bowstring and arrow when the drawn bowstring is released. Throughout the initial travel of the arrow, increased force is applied in a continuous, efficient manner which aids the arrow in developing optimum trajectory characteristics. In conventional bows, the energy stored in the limbs of a drawn bow is applied instantaneously when the archer releases the bowstring. Such instantaneous impulse of energy may produce instability in the flight characteristics of the arrow.

It has been found advantageous to provide friction reducing rollers 28 on the ends of the pivot members 27 which make contact with the flexible members 26. The friction reducing rollers can be small pulleys which are attached to the ends of the pivot members 27 and adapted to roll on the surface of the flexible member. In addition to reducing friction, such rollers 28 also reduce wear of the flexible members 26 where they are contacted by the pivot members 27.

The bow limbs 11 and 12 can either be rigid and substantially inflexible, or they can be made of flexible materials used in conventional bows. In embodiments comprising rigid, essentially inflexible bow limbs 11 and 12, the bow is truly a compound bow, with all the energy of the drawn bowstring being stored in the stressed flexible members 26. When the bow limbs are made of a flexible material, the bow exhibits hybrid characteristics including some attributes of a compound bow and some attributes of a conventional bow. Energy from the drawn bowstring is stored in both the stresses imparted to the flexible members 26 as well as the flexible limbs. At full draw, the archer must maintain at least that amount of pull necessary to sustain the flexible bow limbs in their stressed condition. The energy stored in the bow limbs is imparted instantaneously upon release of the bowstring, and the energy stored in the flexible members 26 is progressively released to the bowstring.

Figure 12:
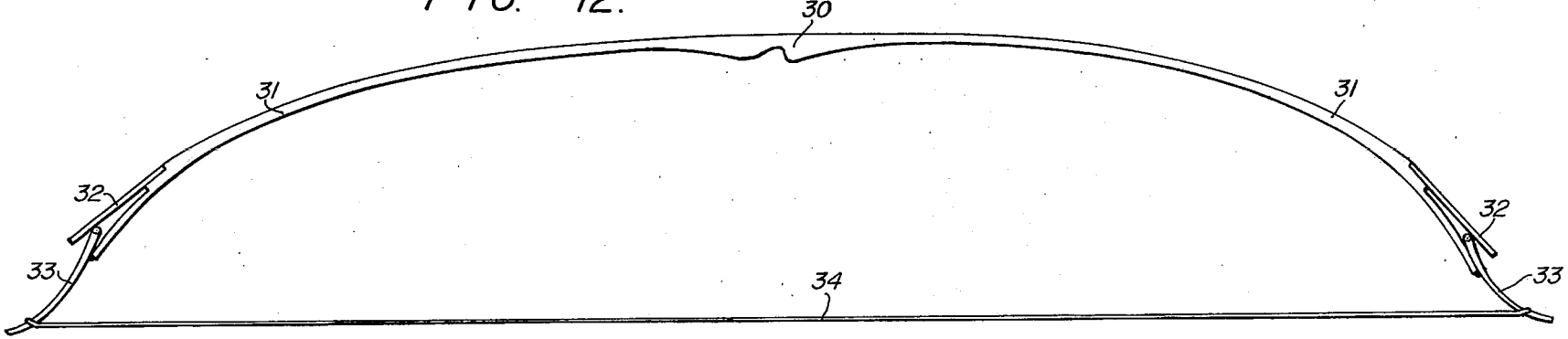

The compound feature of the bow shown in FIGS. 8–11 can also be achieved in a single piece bow as shown in FIG. 12. The bow comprises a handle section 30 with a pair of integrally attached bow limbs 31 extending therefrom in generally opposite directions. A pair of flexible elongate members 32 are attached, respectively, to the backsides of the limb members 31 so as to extend inwardly from the tip ends of the limb members 31 along at least a portion of the backsides of the limb members, with the inwardly extending ends of the flexible members being firmly secured to the respective limb members. A pair of rigid, elongate pivot members 33 are pivotally attached, respectively, to the tip ends of the limb members 31. The pivot members 33 are attached to the limb members 31 at a point intermediate the ends of the pivot members 33, with corresponding ends of the respective pivot members 33 being positioned between the limb members 31 and the flexible members 32, and with the opposite ends of the respective pivot members 33 extending outwardly from the tips of the limb members 31. The outwardly extending ends of the pivot members are adapted to have a bowstring 34 strung therebetween, as shown. When the bowstring 34 is drawn, the pivot members 33 rotate about their pivot points at the tip ends of the limb members 31 so that the inwardly extending ends thereof located between the limb members 31 and the flexible members 32 deflect the flexible members 32 away from the limb members 31. The compound action achieved by the bow shown in FIG. 12 is identical in nature to that described with respect to the bow shown in FIGS. 8–11. The bow limbs 31 of the bow shown in FIG. 12 can be either rigid, essentially inflexible material or they can be made of flexible materials used in conventional bows. As was explained with reference to the bow shown in FIGS. 8–11, in embodiments comprising essentially inflexible bow limbs 31, the bow will exhibit truly compound characteristics, and when the bow limbs 31 are made of a flexible material, the bow will exhibit hybrid characteristics including some attributes of a compound bow and some attributes of a conventional bow.

The passageways 16 and 17 can be offset slightly from the centerline of the bow so that the portion of the bowstring 15 at the back of the bow will not make contact with the arrow in a center shot bow. Thus, the passageways 16 and 17 shown in FIG. 2 could be offset slightly to the left, thereby moving the portion of the bowstring 15 away from the centerline of the bow.

Whereas there is here described certain preferred embodiments which are presently regarded as exhibiting the best mode of carrying out the invention, it should be understood that various changes may be made and other modifications adopted without departing from the disclosed inventive concepts particularly pointed out in the following claims.

What I claim is:

1. A foldable archery bow comprising a pair of limbs and hinge means connecting the bow limbs together in end-to-end relationship for pivotal movement about an axis adjacent the back of the bow and transverse to the direction of the draw of the bow, wherein the interconnected, corresponding end portions of the bow limbs are enlarged with respect to the remainder of said limbs so as to form a handle portion of the bow; the handle end portion of each bow limb has a passageway therethrough extending from the bellyside to the backside thereof; at least one of the bow limbs has a pulley positioned at the tip end of the limb, said pulley having its axis transverse to the plane of the bow; and a bowstring is provided, extending from the tip end of the other bow limb to and around the pulley at the tip end of the first bow limb, through the passageway in the handle end portion of said first bow limb to the backside of the bow, then through the passageway in the handle end portion of said other bow limb, and to its origin at the end of said other bow limb, whereby the bow limbs can be rotated from their aligned, operable position to a folded position in which said limbs are adjacent each other with the backs thereof facing each other.

2. A bow in accordance with claim 1, wherein each of the other ends of the bow limbs is provided with a pulley having its axis transverse to the plane of the bow; and a bowstring is provided in the handle end portion of one of the limbs, around the pulley at the end of that bow limb, to and around the pulley at the end of the other bow limb, and through the passageway in the handle end portion of the other bow limb to its origin at the backside of the bow.

3. A bow in accordance with claim 2, wherein means are provided for preventing translational movement of the bowstring through the passageway in the handle end portion of one of the bow limbs.

4. A bow in accordance with claim 3, wherein the means for preventing translational movement of the bowstring through a passageway in the handle end portion of the one bow limb, comprises an adjustable member in the body of that bow limb, and means for binding the bowstring between said adjustable member and the body of said handle end portion.

5. A bow in accordance with claim 3, wherein a pair of pulleys are provided at respective ends of the passageway through the handle end portion of the other of the bow limbs so that the bowstring is guided around the pulleys as it traverses that passageway.

6. A bow in accordance with claim 3, wherein the handle end portions of the bow limbs have longitudinal grooves therein, respectively, on the backsides thereof extending from the passageways therein to the end handle portions which are interconnected by the hinge means, said grooves accommodating the portion of the bowstring at the back of the bow when the bow limbs are aligned in their operable position.

7. A bow in accordance with claim 3, wherein the terminal end of each of the handle end portions interconnected by the hinge means has a pulley positioned adjacent the bellyside thereof, to accommodate the bowstring when the bow limbs are in their folded position.

8. A bow in accordance with claim 3, wherein the terminal ends of the handle end portions of the bow limbs which are interconnected by the hinge means are provided with shock absorber means, which allow the bow limbs to be brought to their operable in-line position in a smooth, controlled manner rather than being snapped together.

9. A bow in accordance with claim 3, wherein the shock absorber means comprises a hydraulic plunger positioned within a bore extending longitudinally into the handle portion of one of the bow limbs from the end face thereof, said hydraulic plunger having a drive rod extending outwardly from the bore and being adapted to be pushed slowly inwardly against the hydraulic plunger; and spring means for returning the drive rod to its extended position when the force pushing it inwardly is removed, whereby when the bow limbs are unfolded, the face of the end of the handle portion of the other bow limb contacts the drive rod slowly pushing the drive rod inwardly into said bore thereby permitting the ends of said limbs to come together in a controlled manner.

10. A bow in accordance with claim 1, wherein at least one of the limb members has a flexible, elongate member attached to the backside thereof so as to extend inwardly from the tip end of that limb member along at least a portion of the backside thereof, with the inwardly extending end of the flexible member being firmly secured to the respective limb member; and the tip end of at least that limb member to which said flexible member is attached comprises a rigid, elongate pivot member which is pivotally attached at a point intermediate its ends to the end of the respective limb member, with corresponding ends of the pivot member positioned between the limb member and the flexible member of the respective bow limb, and with the opposite end of the pivot member extending outwardly from the end of the respective limb member, said opposite end of the pivot member being provided with said pulley, whereby when said bowstring is drawn, the pivot member rotates about its pivot connection to the limb member and the end of the pivot member located between the limb member and the flexible member deflects the flexible member away from the limb member.

11. A bow in accordance with claim 10, wherein the tip ends of both the limb members are provided with a pulley; and an endless bowstring extends from the backside of the bow through the passageway in the handle end portion of one of the bow limbs, around the pulley at the end of the pivot member connected to that bow limb, to and around the pulley at the end of the pivot member on the other bow limb, through the passageway in the handle end portion of the other bow limb to its origin at the backside of the bow.

12. A bow in accordance with claim 11, wherein rotatable bearing members are provided at the ends of the respective pivot members which are positioned between the limb members and the flexible members of the respective bow limbs so that the bearing member makes rolling contact with the flexible members.

13. A bow in accordance with claim 11, wherein the elongate limb members are substantially inflexible.

14. An archery bow comprising a handle section; a pair of elongate limb members extending from the handle section as the upper and lower bow limbs, respectively; a pair of flexible, elongate members which are attached respectively, to the backsides of the limb members so as to extend inwardly from the tip ends of the limb members along at least a portion of the backsides of the limb members, with the inwardly extending ends of the flexible members being firmly secured to the respective limb members; and a pair of rigid, elongate pivot members, each pivot member being pivotally attached at a point intermediate its ends to the tip end of one of the respective limb members, with corresponding ends of the respective pivot members being positioned between the limb members and the flexible members of the respective bow limbs, and with the opposite ends of the respective pivot members extending outwardly from the tips of the limb members of the respective bow limbs, said opposite ends of the respective bow limbs being adapted to have a bowstring connected therebetween so that when the bowstring is drawn, the pivot members rotate and the ends of the pivot members located between the limb members and the flexible members deflect the flexible members away from the limb members.

15. A bow in accordance with claim 14, wherein the elongate limb members are substantially inflexible.

* * * * *